US006283279B1

(12) United States Patent
Harrington

(10) Patent No.: US 6,283,279 B1
(45) Date of Patent: Sep. 4, 2001

(54) CONTAINER FOR PENCIL-LIKE ITEMS AND BOOKLET-LIKE ITEMS AND HAVING A SYMBOLIC PERSON-LIKE SHAPE

(76) Inventor: Kirk D. Harrington, 631 Conestoga Trail, Chanhassen, MN (US) 55317

( * ) Notice: Subject to any disclaimer, the term of this patent is extended or adjusted under 35 U.S.C. 154(b) by 0 days.

(21) Appl. No.: 09/495,524

(22) Filed: Jan. 31, 2000

(51) Int. Cl.[7] ..... B65D 85/28

(52) U.S. Cl. ..... 206/214; D3/206; D9/311; 206/457; 220/4.21; 220/523

(58) Field of Search ..... D3/206, 235, 236, D3/270, 271; D9/310, 311, 314, 316; 206/214, 224, 371, 457, 822; 220/4.21, 4.24, 523

(56) References Cited

U.S. PATENT DOCUMENTS 1,589,911 * 6/1926 Waters ..... 206/457
1,987,804 * 1/1935 Saulsbury ..... 206/457
2,868,361 * 1/1959 Zilem et al. ..... 206/457
4,753,346 * 6/1988 Tsuji ..... 206/371
5,002,182 * 3/1991 McGinnis ..... 206/214
5,441,149 * 8/1995 Wilard et al. ..... 206/214
6,021,891 * 2/2000 Anderson ..... 206/214

* cited by examiner

*Primary Examiner*—Jim Foster
(74) *Attorney, Agent, or Firm*—Roger W. Jensen

(57) ABSTRACT

A container for pencil-like items and booklet-like items and having a symbolic person-like shape. The container has substantially identical externally-shaped top and bottom planar members, each having a head portion, a body portion, two spaced-apart leg portions and two arm portions. The leg portions and arm portions extend longitudinally downwardly in spaced-apart parallel relationship with respect to the body portion.

2 Claims, 3 Drawing Sheets

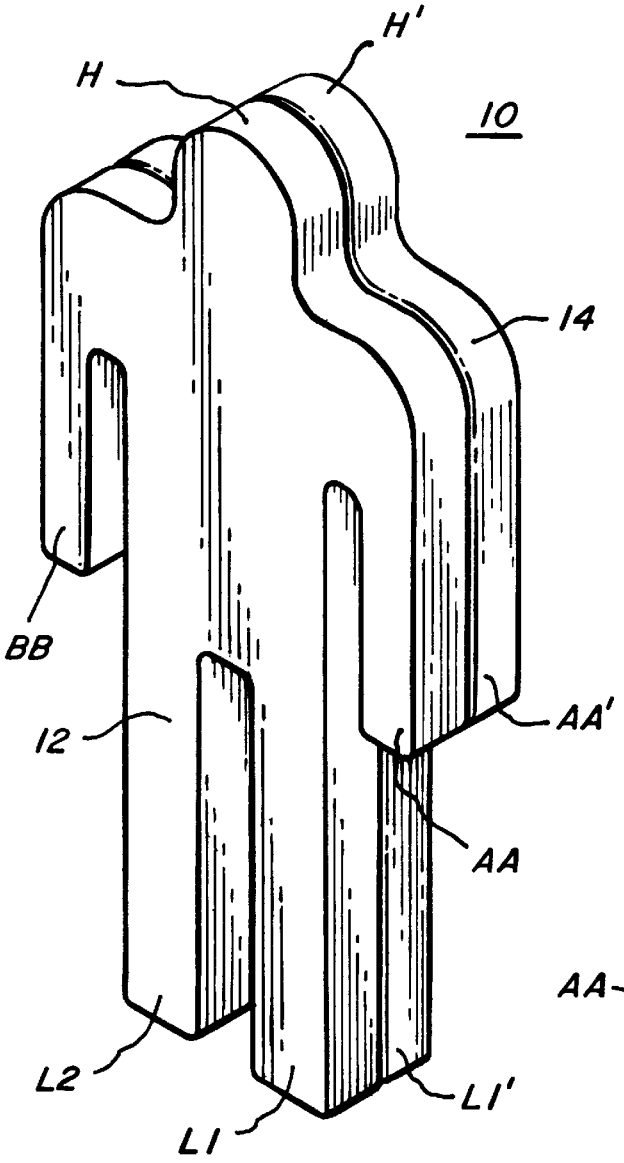
FIG. 1
FIG. 2
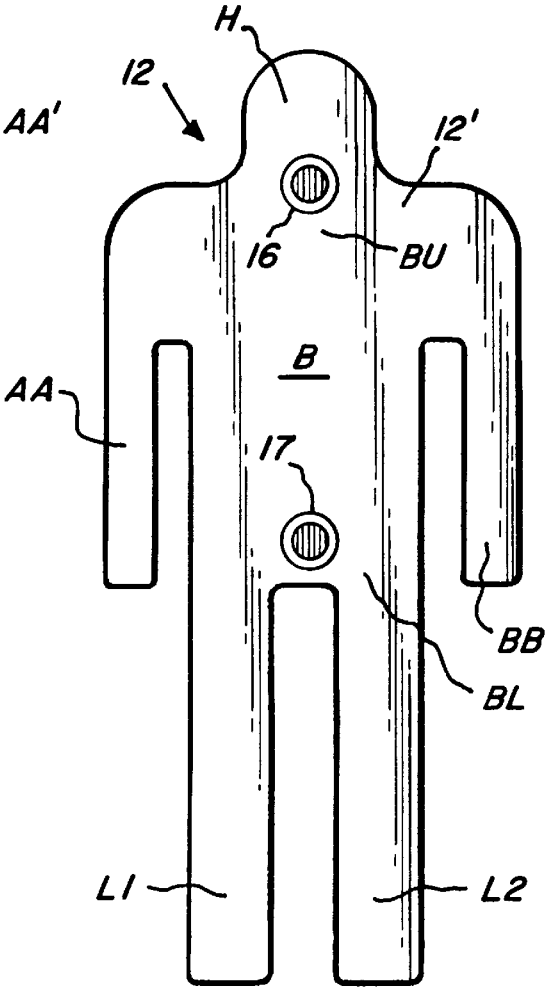

FIG. 5
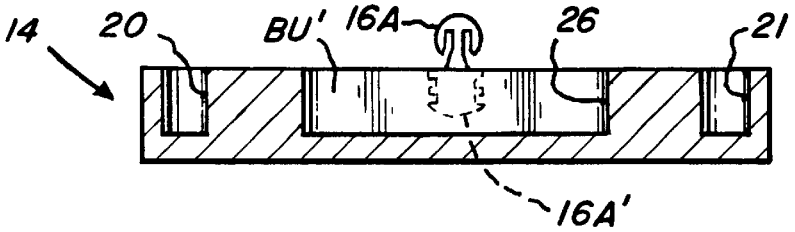
FIG. 6
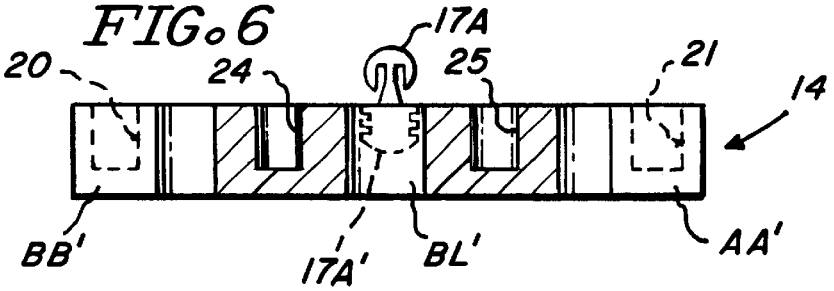
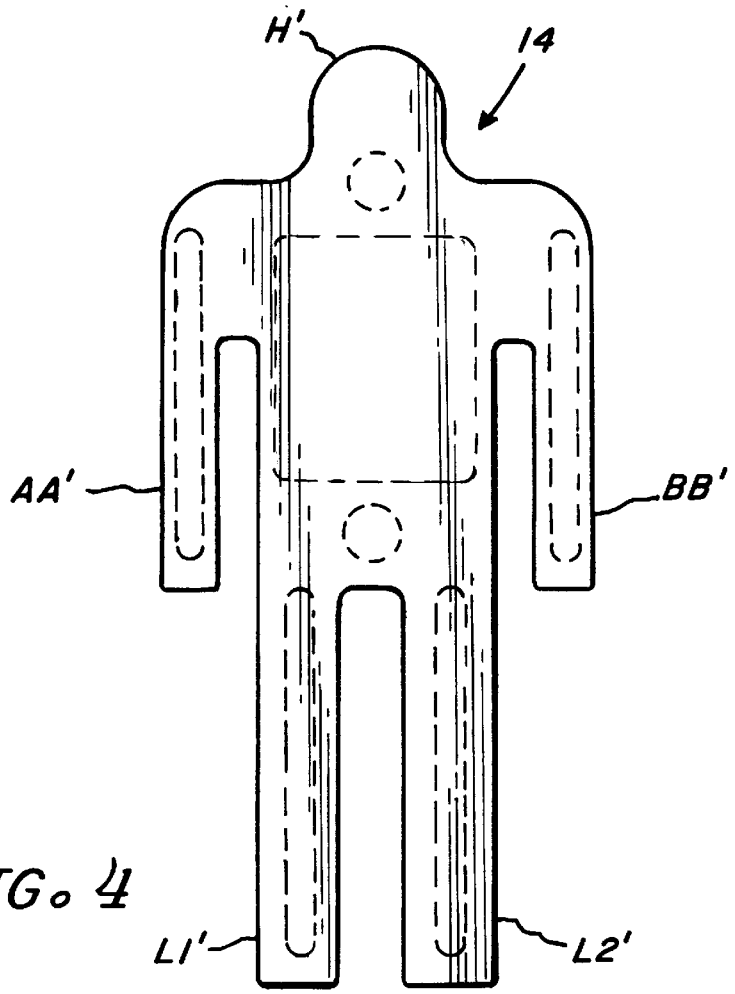
FIG. 4

CONTAINER FOR PENCIL-LIKE ITEMS AND BOOKLET-LIKE ITEMS AND HAVING A SYMBOLIC PERSON-LIKE SHAPE

BACKGROUND OF THE INVENTION

The prior art contains numerous examples of pencil-boxes and the like having a wide variety of shapes and sizes, for the storage of pencils and other school supplies.

SUMMARY OF THE INVENTION

The present invention provides, in general terms, a container for pencil-like items and booklet-like items where the container has a symbolic person-like shape, a shape well calculated to appeal to children because of its doll-like configuration.

More specifically, the present invention provides a container as aforedescribed and comprising substantially identical externally shaped top and bottom members. Each of the members is flat, i.e., planar, and has a preselected thickness. Each of the members has a head portion, a body portion having an upper end and a lower end, and two spaced-apart leg portions extending longitudinally in parallel spaced-apart relationship from the lower end of the body. Each member further has two arm portions connected respectively to opposite lateral sides of the upper end of the body portion, and extending longitudinally downwardly in spaced-apart parallel relationship with the body portion.

The bottom member has an inside surface and a plurality of longitudinal elongated recesses extending part way, but not through, the members. More specifically, there are a pair of longitudinal elongated recesses in the inside surface of said arms (one for each arm) and likewise an elongated longitudinal recess in each of the leg portions, the aforesaid recesses being preselected in size so as to easily receive pencil-like items. In the body portion of the bottom member, on the inside surface, is a larger recess having significant transverse and longitudinal dimensions for receiving booklet-like items, such as a booklet on values, avoidance of alcohol or other drugs, etc. The bottom member further includes a pair of spaced-apart fastening means which, in the preferred embodiment, are male members.

The top member of the container also has an inside surface with longitudinally spaced-apart fastening means positioned and adapted to co-act with the fastening means of the bottom member, so as permit and provide selective assembly and disassembly of said top and bottom members. In the preferred embodiment, the fastening means integral with the top member are female means.

BRIEF DESCRIPTION OF THE DRAWINGS

FIG. 1 is a front top right isometric view of a container representing the preferred embodiment of my invention.

FIG. 2 is a plan view of the inside surface of the top portion 12 of the container.

FIG. 4 is a plan view of the outside or back surface of bottom member 14 of the container.

FIG. 5 is cross-sectional view of the bottom member 14 as viewed along section line 5—5 of FIG. 3.

FIG. 6 is a cross-sectional view of the bottom member 14 as viewed along section line 6—6 of FIG. 3.

DETAILED DESCRIPTION OF THE INVENTION

Figure 3:
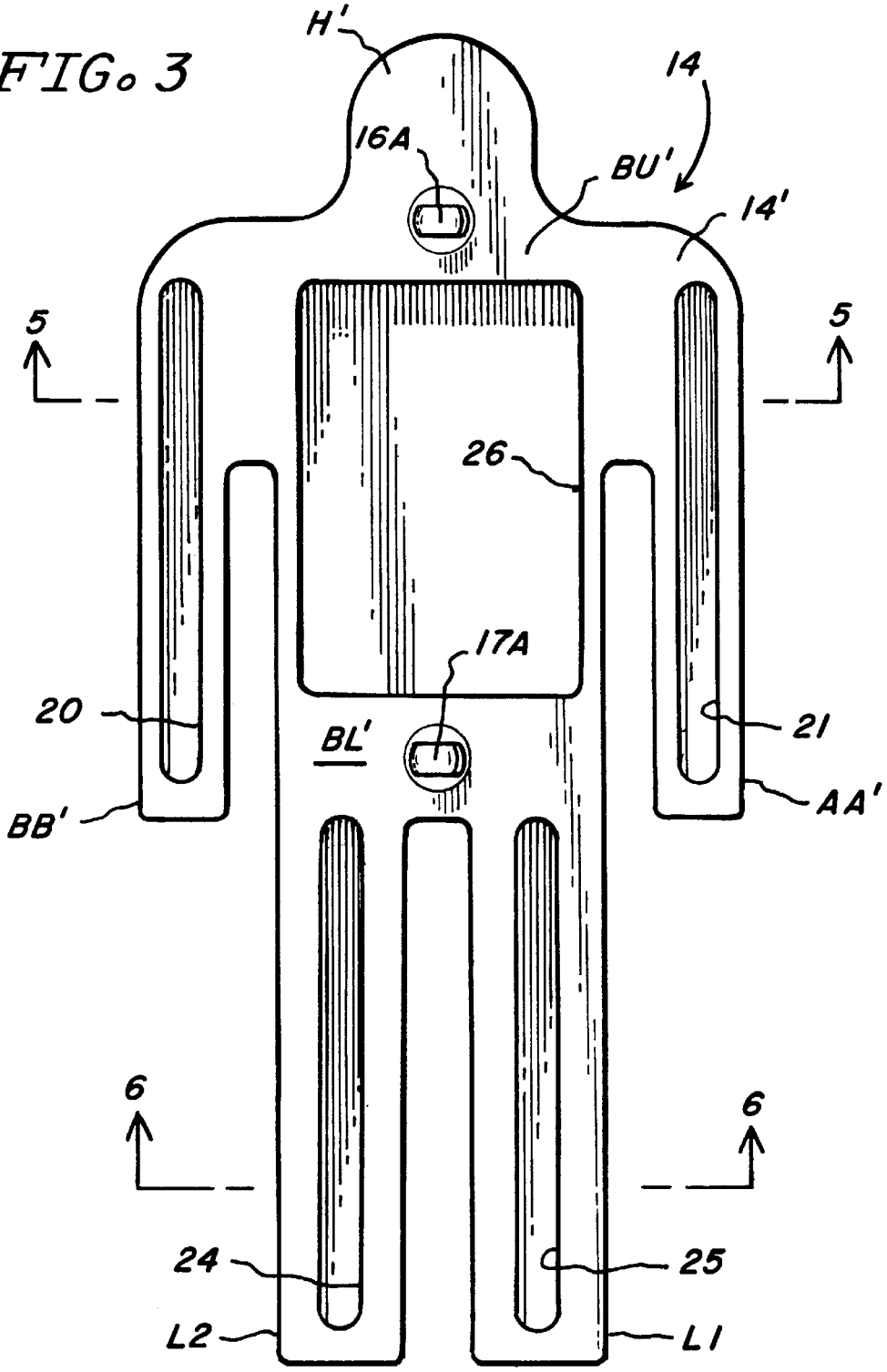
FIG. 3 is a plan view of the inside surface of the bottom portion 14 of the container.

FIG. 1 depicts a container for pencil-like items and booklet-like items and having a symbolic person-like shape, the container being identified by reference numeral 10 and comprising, substantially, identically externally-shaped top and bottom members: a top member 12 and a bottom member 14. Members 12 and 14 are shown to be flat, i.e., planar, and have a preselected thickness which, in the preferred embodiment, are equal. Members 12 and 14 have head portions H and H', respectively. Top member 12 has a body portion B having upper and lower ends BU and BL, respectively; likewise, bottom member 14, as shown in FIG. 3, has upper and lower body ends BU' and BL'. Top member 12, as shown in FIGS. 1 and 2, has a pair of spaced-apart leg portions L1 and L2 extending longitudinally in parallel spaced-apart relationship from the lower end BL of the body portion; the corresponding legs for the bottom member 14 are L1' and L2', as shown in FIG. 3. The top member 12 further comprises two arm portions AA and BB connected respectively to opposite sides of the upper end BU of the body portion. As shown clearly in FIG. 2, the arm portions AA and BB extend longitudinally downwardly in spaced-apart parallel relationship with the body portion B. Likewise, the bottom member 14 has corresponding arms AA' and BB', connected respectively to opposite sides of the upper end BU' and extending longitudinally downwardly in spaced-apart parallel relationship with the body portion.

The bottom member 14 has an inside surface 14' shown in FIG. 3, and has longitudinal elongated recesses 20 and 21 in said surface 14' of arms BB' and AA' respectively. It will be noted from FIG. 3 that recesses 20 and 21 are significantly elongated and, in the preferred embodiment, are sufficiently sized so as to freely receive a pencil-like item, such as a small color pencil, or the like. In addition, each of the legs L2' and L1' have similar longitudinally extending recesses, 24 and 25, respectively, for providing additional storage of pencil-like items.

A larger recess 26 is provided in the inside surface of member 14 in the body zone. As depicted in FIG. 3, recess 26 has significant longitudinal and transverse extents, so as to provide an appropriate storage for booklet-like items.

The invention further provides means for selective repeatable assembly and disassembly of the top and bottom members 12 and 14. In the preferred embodiment, this function is provided by a pair of longitudinally spaced-apart, female-type fastening means 16 and 17, recessed from the inside surface 12' of the top member 12, and a pair of matching and mating male-type fastening means 16A and 17A, secured respectively in the upper and lower ends BU' and BL' of the body portion of the bottom member 14, and projecting above the inside surface 14' as is clearly shown in FIGS. 5 and 6.

In use, the container, when assembled, may be stood on end with the four legs L1, L1', L2 and L2' supporting the container, and the container may also be laid flat on a supporting surface. If a child or other user wants to gain access to the contents of the recesses 20, 21, 24, 25 or 26, then the user merely pulls the members 12 and 14 apart, preferably keeping the bottom member 14 in a bottom-horizontal position, so as to avoid the spilling of the contents from the recesses. The fastening means 16 and 17, and 16A and 17A, permit easy disassembly of members 12 and 14, as well as reliable reassembly whereby the assembled members can be vigorously handled without fear of an unintended disassembly with a spilling of the contents of the recesses.

While the preferred embodiment of the invention has been illustrated, it will be understood that variations may be made by those skilled in the art without departing from the inventive concept. Accordingly, the invention is to be limited only by the scope of the following claims.

I claim:

1. A container for pencil-like items and booklet-like items and having a symbolic person-like shape, said container comprising:

substantially identically externally shaped top and bottom members, each of said members being planar and having a preselected thickness, a head portion, a body portion having an upper end and a lower end, two spaced-apart leg portions extending longitudinally in parallel spaced-apart relationship from said lower end of said body, and two arm portions connected respectively to opposite sides of said upper end of said body portion and extending longitudinally downwardly in spaced-apart parallel relationship with said body portion;

said bottom member having an inside surface, longitudinal elongated recesses in said inside surface of said arm and leg portions thereof for receiving pencil-like items, a transverse and longitudinal elongated recess in said inside surface of said body portion for receiving booklet-like items, and longitudinally spaced-apart fastening means; and said top member having an inside surface with longitudinally spaced-apart fastening means adapted to coact with said bottom member fastening means to provide selective assembly and disassembly of said top and bottom members.

2. The container of claim 1, wherein said fastening means comprise female means on one of said members and male means on the other of said members.

* * * * *